US008062051B2

(12) United States Patent
Ngo

(10) Patent No.: US 8,062,051 B2
(45) Date of Patent: Nov. 22, 2011

(54) ELECTRICAL COMMUNICATION SYSTEM HAVING LATCHING AND STRAIN RELIEF FEATURES

(75) Inventor: Hung Viet Ngo, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 155 days.

(21) Appl. No.: 12/499,266

(22) Filed: Jul. 8, 2009

(65) Prior Publication Data

US 2010/0029126 A1 Feb. 4, 2010

Related U.S. Application Data

(60) Provisional application No. 61/084,355, filed on Jul. 29, 2008.

(51) Int. Cl.
*H01R 13/627* (2006.01)
*H01R 13/58* (2006.01)

(52) U.S. Cl. ..... 439/352; 439/460

(58) Field of Classification Search ..... 439/352, 439/350, 449, 460, 452, 501
See application file for complete search history.

(56) References Cited

U.S. PATENT DOCUMENTS

| | | | |
|---|---|---|---|
| 318,186 | A | 5/1885 | Hertzog |
| 741,052 | A | 10/1903 | Mahon |
| 1,477,527 | A | 12/1923 | Raettig |
| 2,248,675 | A | 7/1941 | Huppert |
| 2,430,011 | A | 11/1947 | Gillentine |
| 2,759,163 | A | 8/1956 | Ustin et al. |
| 2,762,022 | A | 9/1956 | Benander et al. |
| 2,844,644 | A | 7/1958 | Soule, Jr. |
| 3,011,143 | A | 11/1961 | Dean |
| 3,178,669 | A | 4/1965 | Roberts |
| 3,208,030 | A | 9/1965 | Evans et al. |
| 3,286,220 | A | 11/1966 | Marley et al. |
| 3,411,127 | A | 11/1968 | Adams |
| 3,420,087 | A | 1/1969 | Hatfield et al. |
| 3,514,740 | A | 5/1970 | Filson et al. |
| 3,538,486 | A | 11/1970 | Shlesinger, Jr. |
| 3,634,811 | A | 1/1972 | Teagno |
| 3,669,054 | A | 6/1972 | Desso et al. |
| 3,692,994 | A | 9/1972 | Hirschmann et al. |
| 3,748,633 | A | 7/1973 | Lundergan |
| 3,845,451 | A | 10/1974 | Neidecker |

(Continued)

FOREIGN PATENT DOCUMENTS

DE 1 665 181 4/1974

(Continued)

OTHER PUBLICATIONS

U.S. Appl. No. 12/317,366, filed Dec. 22, 2008, Minich.

(Continued)

*Primary Examiner* — Chandrika Prasad
(74) *Attorney, Agent, or Firm* — Woodcock Washburn LLP

(57) ABSTRACT

An electrical communication system includes at least one electrical connector system that includes a header connector configured to mate with a receptacle connector through a back panel. The connector system includes a latch that releasably mates the header and receptacle connectors. The receptacle connector is mounted to a substrate, such as a printed circuit board, and the header connector is connected to a power cable assembly. The power cable assembly includes a faston that electrically connects a power cable to the electrical contacts of the header connector.

15 Claims, 9 Drawing Sheets

U.S. PATENT DOCUMENTS

| | | | | |
|---|---|---|---|---|
| 3,871,015 | A | | 3/1975 | Lin et al. |
| 3,942,856 | A | | 3/1976 | Mindheim et al. |
| 3,972,580 | A | | 8/1976 | Pemberton et al. |
| 4,070,088 | A | | 1/1978 | Vaden |
| 4,076,362 | A | | 2/1978 | Ichimura |
| 4,082,407 | A | | 4/1978 | Smorzaniuk et al. |
| 4,136,919 | A | | 1/1979 | Howard et al. |
| 4,159,861 | A | | 7/1979 | Anhalt |
| 4,217,024 | A | | 8/1980 | Aldridge et al. |
| 4,260,212 | A | | 4/1981 | Ritchie et al. |
| 4,288,139 | A | | 9/1981 | Cobaugh et al. |
| 4,371,912 | A | | 2/1983 | Guzik |
| 4,383,724 | A | | 5/1983 | Verhoevan |
| 4,402,563 | A | | 9/1983 | Sinclair |
| 4,403,821 | A | | 9/1983 | Zimmerman et al. |
| 4,473,113 | A | | 9/1984 | Whitfield et al. |
| 4,505,529 | A | | 3/1985 | Barkus |
| 4,533,187 | A | | 8/1985 | Kirkman |
| 4,536,955 | A | | 8/1985 | Gudgeon |
| 4,545,610 | A | | 10/1985 | Lakritz et al. |
| 4,552,425 | A | | 11/1985 | Billman |
| 4,560,222 | A | | 12/1985 | Dambach |
| 4,564,259 | A | | 1/1986 | Vandame |
| 4,596,433 | A | | 6/1986 | Oesterheld et al. |
| 4,685,886 | A | | 8/1987 | Denlinger et al. |
| 4,717,360 | A | | 1/1988 | Czaja |
| 4,767,344 | A | | 8/1988 | Noschese |
| 4,776,803 | A | | 10/1988 | Pretchel et al. |
| 4,782,893 | A | | 11/1988 | Thomas |
| 4,790,763 | A | | 12/1988 | Weber et al. |
| 4,815,987 | A | | 3/1989 | Kawano et al. |
| 4,818,237 | A | | 4/1989 | Weber |
| 4,820,169 | A | | 4/1989 | Weber et al. |
| 4,820,182 | A | | 4/1989 | Harwath et al. |
| 4,867,713 | A | | 9/1989 | Ozu et al. |
| 4,878,611 | A | | 11/1989 | LoVasco et al. |
| 4,881,905 | A | | 11/1989 | Demler, Jr. et al. |
| 4,900,271 | A | | 2/1990 | Colleran et al. |
| 4,907,990 | A | | 3/1990 | Bertho et al. |
| 4,915,641 | A | | 4/1990 | Miskin et al. |
| 4,963,102 | A | | 10/1990 | Gettig et al. |
| 4,965,699 | A | | 10/1990 | Jordan et al. |
| 4,973,257 | A | | 11/1990 | Lhotak |
| 4,973,271 | A | | 11/1990 | Ishizuka et al. |
| 4,974,119 | A | | 11/1990 | Martin |
| 4,975,084 | A | | 12/1990 | Fedder et al. |
| 4,979,074 | A | | 12/1990 | Morley et al. |
| 5,016,968 | A | | 5/1991 | Hammond et al. |
| 5,024,610 | A | | 6/1991 | French et al. |
| 5,035,639 | A | | 7/1991 | Kilpatrick et al. |
| 5,046,960 | A | | 9/1991 | Fedder et al. |
| 5,052,953 | A | | 10/1991 | Weber |
| 5,066,236 | A | | 11/1991 | Broeksteeg |
| 5,077,893 | A | | 1/1992 | Mosquera et al. |
| 5,082,459 | A | | 1/1992 | Billman et al. |
| 5,094,634 | A | | 3/1992 | Dixon et al. |
| 5,104,332 | A | | 4/1992 | McCoy |
| 5,137,959 | A | | 8/1992 | Block et al. |
| 5,139,426 | A | | 8/1992 | Barkus et al. |
| 5,151,056 | A | | 9/1992 | McClune |
| 5,152,700 | A | | 10/1992 | Bogursky et al. |
| 5,174,770 | A | | 12/1992 | Sasaki et al. |
| 5,194,480 | A | | 3/1993 | Block et al. |
| 5,213,868 | A | | 5/1993 | Liberty et al. |
| 5,214,308 | A | | 5/1993 | Nishiguchi |
| 5,238,414 | A | | 8/1993 | Yaegashi et al. |
| 5,254,012 | A | | 10/1993 | Wang |
| 5,274,918 | A | | 1/1994 | Reed |
| 5,276,964 | A | | 1/1994 | Anderson, Jr. et al. |
| 5,286,212 | A | | 2/1994 | Broeksteeg |
| 5,295,843 | A | | 3/1994 | Davis et al. |
| 5,298,791 | A | | 3/1994 | Liberty et al. |
| 5,302,135 | A | | 4/1994 | Lee |
| 5,321,582 | A | | 6/1994 | Casperson |
| 5,336,101 | A | * | 8/1994 | Kasugai et al. ..... 439/272 |
| 5,381,314 | A | | 1/1995 | Rudy, Jr. et al. |
| 5,397,246 | A | * | 3/1995 | Defibaugh et al. ..... 439/352 |
| 5,400,949 | A | | 3/1995 | Hirvonen et al. |
| 5,427,543 | A | | 6/1995 | Dynia |
| 5,431,578 | A | | 7/1995 | Wayne |
| 5,457,342 | A | | 10/1995 | Herbst, II |
| 5,458,426 | A | | 10/1995 | Ito |
| 5,475,922 | A | | 12/1995 | Tamura et al. |
| 5,490,040 | A | | 2/1996 | Gavdenzi et al. |
| 5,511,987 | A | | 4/1996 | Shinchi |
| 5,512,519 | A | | 4/1996 | Hwang |
| 5,533,915 | A | | 7/1996 | Deans |
| 5,558,542 | A | | 9/1996 | O' Sullivan et al. |
| 5,564,952 | A | | 10/1996 | Davis et al. |
| 5,577,928 | A | | 11/1996 | Duclos |
| 5,588,859 | A | | 12/1996 | Maurice |
| 5,590,463 | A | | 1/1997 | Feldman et al. |
| 5,609,502 | A | | 3/1997 | Thumma |
| 5,618,187 | A | | 4/1997 | Goto |
| 5,637,008 | A | | 6/1997 | Kozel |
| 5,643,009 | A | | 7/1997 | Dinkel et al. |
| 5,664,968 | A | | 9/1997 | Micklevicz |
| 5,664,973 | A | | 9/1997 | Emmert et al. |
| 5,667,392 | A | | 9/1997 | Kocher et al. |
| 5,691,041 | A | | 11/1997 | Frankeny et al. |
| 5,702,255 | A | | 12/1997 | Murphy et al. |
| 5,727,963 | A | | 3/1998 | LeMaster |
| 5,730,609 | A | | 3/1998 | Harwath |
| 5,741,144 | A | | 4/1998 | Elco et al. |
| 5,741,161 | A | | 4/1998 | Cahaly et al. |
| 5,742,484 | A | | 4/1998 | Gillette et al. |
| 5,743,009 | A | | 4/1998 | Matsui et al. |
| 5,745,349 | A | | 4/1998 | Lemke |
| 5,746,608 | A | | 5/1998 | Taylor |
| 5,749,746 | A | | 5/1998 | Tan et al. |
| 5,755,595 | A | | 5/1998 | Davis et al. |
| 5,772,451 | A | | 6/1998 | Dozier, II et al. |
| 5,782,644 | A | | 7/1998 | Kiat |
| 5,787,971 | A | | 8/1998 | Dodson |
| 5,795,191 | A | | 8/1998 | Preputnick et al. |
| 5,810,607 | A | | 9/1998 | Shih et al. |
| 5,817,973 | A | | 10/1998 | Elco et al. |
| 5,827,094 | A | | 10/1998 | Aizawa et al. |
| 5,831,314 | A | | 11/1998 | Wen |
| 5,836,774 | A | | 11/1998 | Tan et al. |
| 5,855,493 | A | * | 1/1999 | Shelly ..... 439/465 |
| 5,857,857 | A | | 1/1999 | Fukuda |
| 5,874,776 | A | | 2/1999 | Kresge et al. |
| 5,876,219 | A | | 3/1999 | Taylor |
| 5,876,248 | A | | 3/1999 | Brunker et al. |
| 5,879,173 | A | | 3/1999 | Poplawski et al. |
| 5,882,214 | A | | 3/1999 | Hillbish et al. |
| 5,883,782 | A | | 3/1999 | Thurston et al. |
| 5,888,884 | A | | 3/1999 | Wojnarowski |
| 5,908,333 | A | | 6/1999 | Perino et al. |
| 5,919,050 | A | | 7/1999 | Kehley et al. |
| 5,930,114 | A | | 7/1999 | Kuzmin et al. |
| 5,955,888 | A | | 9/1999 | Frederickson et al. |
| 5,961,355 | A | | 10/1999 | Morlion et al. |
| 5,971,817 | A | | 10/1999 | Longueville |
| 5,975,921 | A | | 11/1999 | Shuey |
| 5,980,270 | A | | 11/1999 | Fjelstad et al. |
| 5,980,321 | A | | 11/1999 | Cohen et al. |
| 5,984,726 | A | | 11/1999 | Wu |
| 5,993,259 | A | | 11/1999 | Stokoe et al. |
| 6,012,948 | A | | 1/2000 | Wu |
| 6,036,549 | A | | 3/2000 | Wulff |
| 6,041,498 | A | | 3/2000 | Hillbish et al. |
| 6,050,862 | A | | 4/2000 | Ishii |
| 6,059,170 | A | | 5/2000 | Jimarez et al. |
| 6,066,048 | A | | 5/2000 | Lees |
| 6,068,520 | A | | 5/2000 | Winings et al. |
| 6,071,152 | A | | 6/2000 | Achammer et al. |
| 6,077,130 | A | | 6/2000 | Hughes et al. |
| 6,089,878 | A | | 7/2000 | Meng |
| 6,095,827 | A | | 8/2000 | Dutkowsky et al. |
| 6,095,862 | A | | 8/2000 | Doye et al. |
| 6,123,554 | A | | 9/2000 | Ortega et al. |
| 6,125,535 | A | | 10/2000 | Chiou et al. |
| 6,139,336 | A | | 10/2000 | Olson |
| 6,146,157 | A | | 11/2000 | Lenoir et al. |
| 6,146,202 | A | | 11/2000 | Ramey et al. |

6,146,203 A 11/2000 Elco et al.
6,152,756 A 11/2000 Huang et al.
6,159,022 A 12/2000 Tsai
6,174,198 B1 1/2001 Wu et al.
6,179,627 B1 1/2001 Daly et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncini et al.
6,234,851 B1 5/2001 Phillips
6,238,225 B1 5/2001 Middlehurst et al.
6,257,478 B1 7/2001 Straub
6,259,039 B1 7/2001 Chroneos, Jr. et al.
6,261,132 B1 7/2001 Koseki et al.
6,269,539 B1 8/2001 Takahashi et al.
6,274,474 B1 8/2001 Caletka et al.
6,280,230 B1 8/2001 Takase et al.
6,293,827 B1 9/2001 Stokoe et al.
6,299,492 B1 10/2001 Pierini et al.
6,309,245 B1 10/2001 Sweeney
6,319,075 B1 11/2001 Clark et al.
6,322,377 B2 11/2001 Middlehurst et al.
6,328,602 B1 12/2001 Yamasaki et al.
6,347,952 B1 2/2002 Hasegawa et al.
6,350,134 B1 2/2002 Fogg et al.
6,359,783 B1 3/2002 Noble
6,360,940 B1 3/2002 Bolde et al.
6,362,961 B1 3/2002 Chiou
6,363,607 B1 4/2002 Chen et al.
6,371,773 B1 4/2002 Crofoot et al.
6,379,188 B1 4/2002 Cohen et al.
6,386,924 B2 5/2002 Long
6,394,818 B1 5/2002 Smalley, Jr.
6,402,566 B1 6/2002 Middlehurst et al.
6,409,543 B1 6/2002 Astbury, Jr. et al.
6,428,328 B2 8/2002 Haba et al.
6,431,914 B1 8/2002 Billman
6,435,914 B1 8/2002 Billman
6,450,829 B1 9/2002 Weisz-Margulescu
6,461,183 B1 10/2002 Ohkita et al.
6,461,202 B2 10/2002 Kline
6,471,523 B1 10/2002 Shuey
6,471,548 B2 10/2002 Bertoncini et al.
6,472,474 B2 10/2002 Burkhardt et al.
6,488,549 B1 12/2002 Weller et al.
6,489,567 B2 12/2002 Zachrai
6,506,081 B2 1/2003 Blanchfield et al.
6,514,103 B2 2/2003 Pape et al.
6,524,134 B2 2/2003 Flickinger et al.
6,537,111 B2 3/2003 Brammer et al.
6,544,046 B1 4/2003 Hahn et al.
6,547,584 B2 * 4/2003 Myer et al. ..... 439/352
6,551,112 B1 4/2003 Li et al.
6,554,647 B1 4/2003 Cohen et al.
6,572,410 B1 6/2003 Volstorf et al.
6,575,774 B2 6/2003 Ling et al.
6,575,776 B1 6/2003 Conner et al.
6,592,381 B2 7/2003 Cohen et al.
6,604,967 B2 8/2003 Middlehurst et al.
6,629,854 B2 10/2003 Murakami
6,652,318 B1 11/2003 Winings et al.
6,663,426 B2 12/2003 Hasircoglu et al.
6,665,189 B1 12/2003 Lebo
6,669,514 B2 12/2003 Weibking et al.
6,672,884 B1 1/2004 Toh et al.
6,672,907 B2 1/2004 Azuma
6,674,645 B2 1/2004 Anzai et al.
6,679,709 B2 1/2004 Takeuchi
6,692,272 B2 2/2004 Lemke et al.
6,702,594 B2 3/2004 Lee et al.
6,705,902 B1 3/2004 Yi et al.
6,712,621 B2 3/2004 Li et al.
6,716,068 B2 4/2004 Wu
6,740,820 B2 5/2004 Cheng
6,743,037 B2 6/2004 Kassa et al.
6,746,278 B2 6/2004 Nelson et al.
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison et al.
6,790,088 B2 9/2004 Ono et al.
6,796,831 B1 9/2004 Yasufuku et al.
6,810,783 B1 11/2004 Larose
6,811,440 B1 11/2004 Rothermel et al.
6,814,590 B2 11/2004 Minich et al.
6,829,143 B2 12/2004 Russell et al.
6,835,103 B2 12/2004 Middlehurst et al.
6,843,687 B2 1/2005 McGowan et al.
6,848,886 B2 2/2005 Schmaling et al.
6,848,950 B2 2/2005 Allison et al.
6,848,953 B2 2/2005 Schell et al.
6,869,294 B2 3/2005 Clark et al.
6,869,308 B2 3/2005 Wu
6,875,046 B2 * 4/2005 Chiu et al. ..... 439/460
6,884,117 B2 4/2005 Korsunsky et al.
6,890,221 B2 5/2005 Wagner
6,905,367 B2 6/2005 Crane, Jr. et al.
6,929,504 B2 8/2005 Ling et al.
6,947,012 B2 9/2005 Aisenbrey
6,975,511 B1 12/2005 Lebo et al.
6,994,569 B2 2/2006 Minich et al.
7,001,189 B1 2/2006 McGowan et al.
7,059,892 B1 6/2006 Trout
7,059,919 B2 6/2006 Clark et al.
7,065,871 B2 6/2006 Minich et al.
7,070,464 B2 7/2006 Clark et al.
7,074,096 B2 7/2006 Copper et al.
7,086,147 B2 8/2006 Caletka et al.
7,090,509 B1 8/2006 Gilliland et al.
7,097,465 B1 8/2006 Korsunsky et al.
7,101,228 B2 9/2006 Hammer et al.
7,104,812 B1 9/2006 Bogiel et al.
7,114,963 B2 10/2006 Shuey et al.
RE039,380 E 11/2006 Davis
7,137,848 B1 11/2006 Trout et al.
7,140,908 B2 * 11/2006 Katsuma ..... 439/489
7,168,963 B2 1/2007 Minich et al.
7,179,117 B2 * 2/2007 Wu ..... 439/460
7,182,642 B2 2/2007 Ngo et al.
7,204,699 B2 4/2007 Stoner
D542,736 S 5/2007 Riku
7,220,141 B2 5/2007 Daily et al.
7,258,562 B2 8/2007 Daily et al.
7,273,382 B2 9/2007 Igarashi et al.
7,303,427 B2 12/2007 Swain
7,335,043 B2 2/2008 Hgo et al.
7,384,289 B2 6/2008 Minich
7,402,064 B2 7/2008 Daily
7,425,145 B2 9/2008 Ngo et al.
7,452,249 B2 11/2008 Daily
7,458,839 B2 12/2008 Ngo
7,470,138 B1 * 12/2008 Chen et al. ..... 439/352
7,476,108 B2 1/2009 Swain
7,541,135 B2 6/2009 Swain
7,651,341 B2 1/2010 Wu
2001/0003685 A1 6/2001 Aritani
2002/0106930 A1 8/2002 Pape et al.
2002/0142676 A1 10/2002 Hosaka et al.
2002/0159235 A1 10/2002 Miller et al.
2002/0193019 A1 12/2002 Blanchfield et al.
2003/0119378 A1 6/2003 Avery
2003/0143894 A1 7/2003 Kline et al.
2003/0219999 A1 11/2003 Minich et al.
2003/0220021 A1 11/2003 Whiteman, Jr. et al.
2003/0236035 A1 12/2003 Kuroda et al.

| | | | | |
|---|---|---|---|---|
| 2005/0112952 | A1 | 5/2005 | Wang et al. | |
| 2006/0003620 | A1 | 1/2006 | Daily et al. | |
| 2006/0128197 | A1 | 6/2006 | McGowan et al. | |
| 2006/0223379 | A1* | 10/2006 | Ho | 439/660 |
| 2006/0281354 | A1 | 12/2006 | Ngo et al. | |
| 2007/0037437 | A1* | 2/2007 | Wu | 439/449 |
| 2007/0293084 | A1 | 12/2007 | Ngo | |
| 2008/0248670 | A1 | 10/2008 | Daily et al. | |
| 2009/0233485 | A1 | 9/2009 | Van Woensel | |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 1 091 449 | B1 | 9/2004 |
| GB | 1 162 705 | | 8/1969 |
| JP | 05344728 | | 12/1993 |
| JP | 6068943 | | 3/1994 |
| JP | 06-236788 | | 8/1994 |
| JP | 07-114958 | | 5/1995 |
| JP | 07169523 | | 7/1995 |
| JP | 08096918 | | 4/1996 |
| JP | 0 812 5379 | | 5/1996 |
| JP | 9199215 | | 7/1997 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 2000-228243 | | 8/2000 |
| JP | 13135388 | | 5/2001 |
| JP | 2003-217785 | | 7/2003 |
| KR | 100517561 | | 9/2005 |
| TW | 576555 | | 8/1990 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 0016445 | | 3/2000 |
| WO | WO 01/29931 | | 4/2001 |
| WO | WO 01/39332 | | 5/2001 |
| WO | WO 02103847 | | 12/2002 |
| WO | WO 2005065254 | | 7/2005 |
| WO | WO 2007064632 | | 6/2007 |
| WO | WO 2008117180 | | 10/2008 |

OTHER PUBLICATIONS

Finan, J.M., "Thermally Conductive Thermoplastics", LNP Engineering Plastics, Inc., Plastics Engineering 2000, www.4spe.org, 4 pages.

Metral 1000 Series, PCB Mounted Receptacle Assembly, FCI Web Site page, 2001, 1 p.

Ogando, J., "And now-An Injection-Molded Heat Exchanger", Sure, plastics are thermal insulators, but additive packages allow them to conduct heat instead, Global Design News, Nov. 1, 2000, 4 pages.

Power TwinBlade™ I/O Cable Connector RA-North-South, No. GS-20_072, Aug. 6, 2007, 11 pages.

Product Datasheets, 10 Bgit/s XENPAK 850 nm Transponder (TRP10GVP2045), Copyright 2005, MergeOptics GmbH, 13 pages.

Product Datasheets, Welome to XENPAK.org., Copyright 2001, http://www.xenpak.org., 1 page.

Sherman, L.M., "Plastics that Conduct Heat", Plastics Technology Online, Jun. 2001, http://www.plasticstechnology.com, 4 pages.

* cited by examiner

ELECTRICAL COMMUNICATION SYSTEM HAVING LATCHING AND STRAIN RELIEF FEATURES

CROSS REFERENCE TO RELATED APPLICATIONS

This application claims the benefit of provisional patent application Ser. No. 61/084,355 filed on Jul. 29, 2008, the disclosure of which is hereby incorporated by reference as if set forth in its entirety herein.

This application is related by subject matter to the inventions disclosed in U.S. Pat. No. 7,168,963, which issued Jan. 30, 2007, U.S. patent application Ser. No. 12/054,023 filed Mar. 24, 2008, and U.S. patent application Ser. No. 12/388,097 filed Feb. 18, 2009, which claims the benefit of U.S. patent application Ser. No. 61/036,795 filed Mar. 14, 2008, the disclosure of each of which is hereby incorporated by reference as if set forth in its entirety herein.

FIELD OF THE DISCLOSURE

The present invention generally relates to electrical connectors, and in particular relates to a cable connectors and cable interconnections.

BACKGROUND

Electrical cable connectors have been developed that pass high speed electrical signals between a printed circuit board and an external device. Conventional connectors include strain relief members for retaining the cables inside the connector housing, and latch mechanisms that secure cable connectors to mating connectors, especially connectors that are mounted onto printed circuit boards or equipment within which the cable is to be associated.

What is desired is a cable connector that provides advantages over conventional cable connectors.

SUMMARY

In one embodiment, a communications system is configured to be mounted onto a back panel. The communications system includes a first electrical connector, a second electrical connector, and a latch. The first electrical connector includes a first housing that retains a first plurality of electrical power contacts. The first electrical connector defines a mating end and a mounting end, wherein the mounting end is configured to mate with a cable assembly. The second electrical connector includes a second housing that retains a second plurality of electrical power contacts. The second electrical connector defines a mating end configured to mate with the mating end of the housing of the first electrical connector, and a mounting end configured to mount onto a substrate. The second electrical connector includes a latch retainer projecting out from the second housing. The latch is pivotally mounted to the first housing about a pivot axis. The latch can be actuated between an engaged configuration whereby the first and second electrical connectors are locked in a mated position, and a disengaged configuration whereby the first and second electrical connectors can be separated from each other. The latch includes a latch body, a spring flange extending inward from the latch body and bearing against the first housing, and a barb projecting inward from the latch body. The barb is configured to interfere with the latch retainer when the latch is in the engaged configuration, and the barb is removed from interference with the latch retainer when the latch is in the disengaged configuration.

DETAILED DESCRIPTION OF ILLUSTRATIVE EMBODIMENTS

Figure 1:
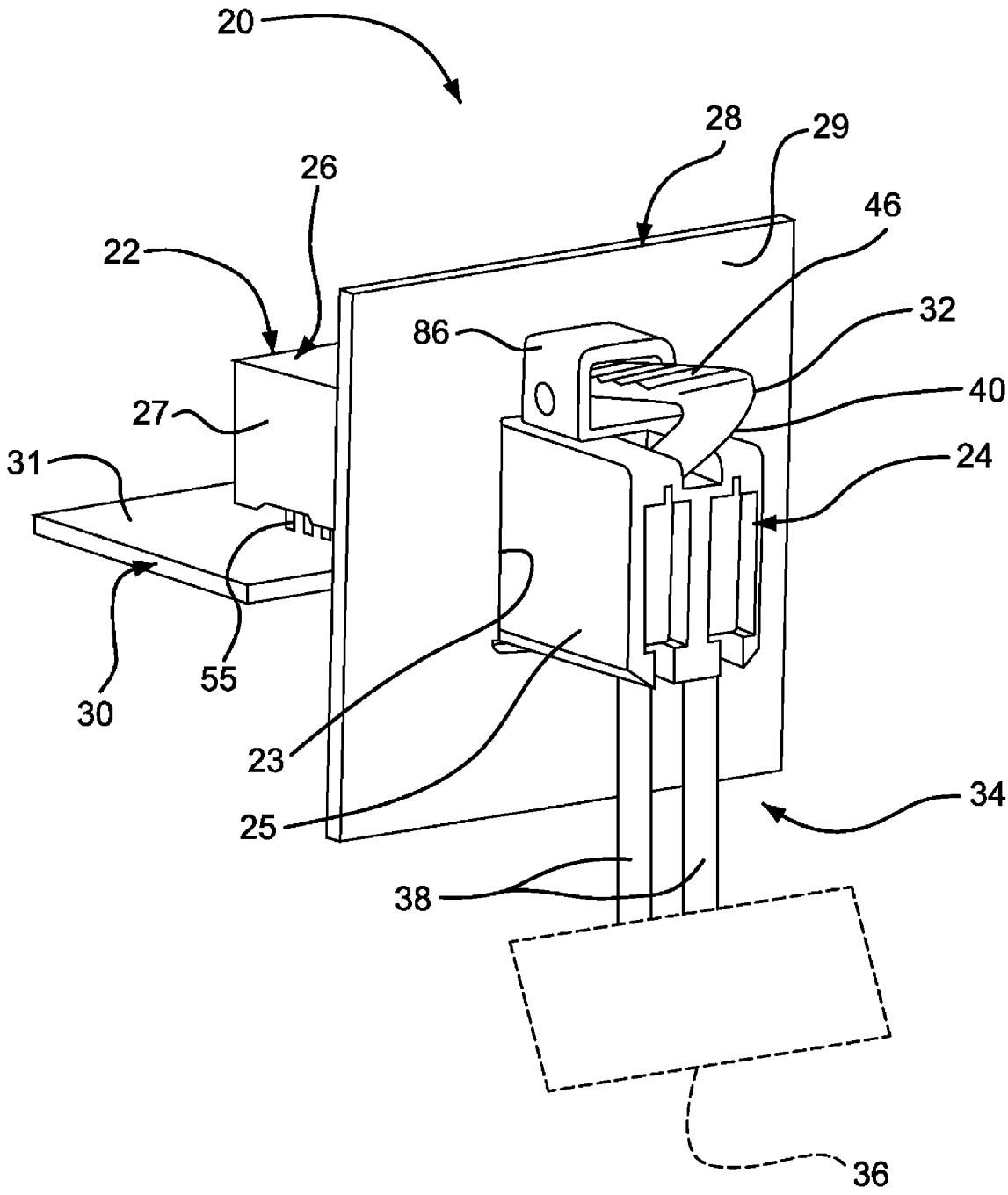
FIG. 1 is a perspective view of a communications system including an electrical connector system, including a header cable connector attached to a receptacle connector, mounted on a panel and connected between a printed circuit board and an electrical device via a power cable assembly.
Figure 2:
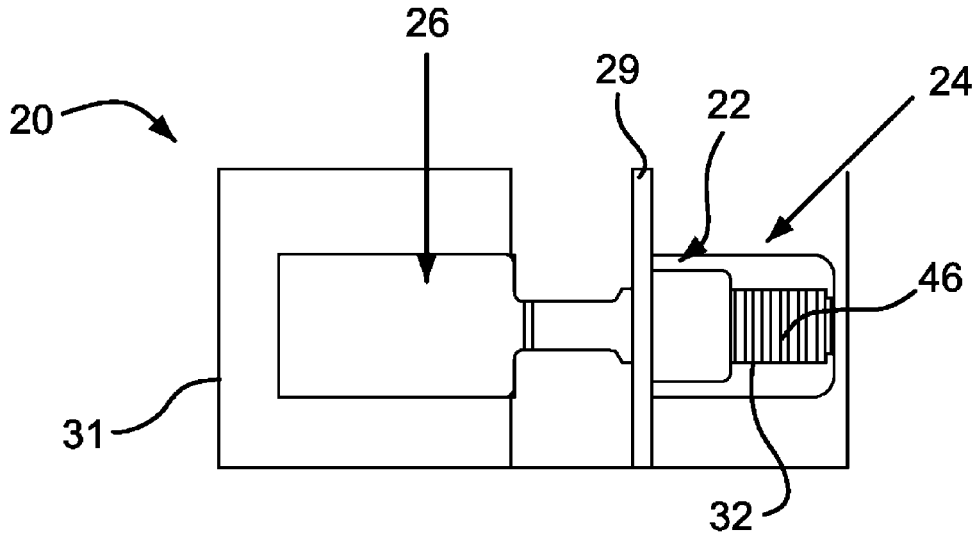
FIG. 2 is a top view of the communications system illustrated in FIG. 1.
Figure 3:
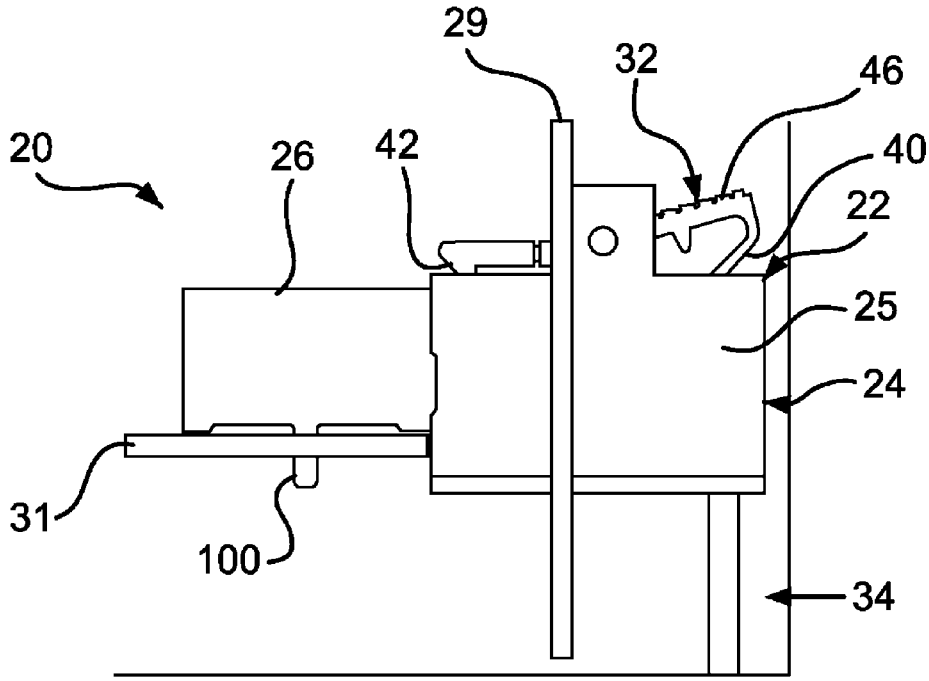
FIG. 3 is a side view of the communications system illustrated in FIG. 1.

Referring to FIGS. 1-3, an electrical I/O (input/output) communication system 20 is configured to transmit electrical power signals between an electrical devices 36 and 30.a can include an electrical connector system 22 including a first electrical connector constructed as a header connector 24, and a second electrical connector constructed as a receptacle connector 26 that receives the contacts of the header connector. The header connector 24 is mounted onto, and extends through, an opening 23 of a vertically oriented substrate 28, which can be provided as a back panel 29. The receptacle connector 26 is mounted onto a horizontally oriented substrate 30, such as a printed circuit board 31. Thus, the printed circuit board 31 is oriented perpendicular to the back panel 29. A single latch 32 releasably secures the header connector 24 to the receptacle connector 26.

The header connector 24 includes an insulating dielectric housing 25 that carries a plurality of electrical power header contacts 54 (see FIG. 5) that are connected an external electrical device 36 via corresponding I/O cables 38 of corresponding power cable assemblies 34. The header connector 24 and power cable assembly 34 provide a cable connector assembly 21. The receptacle connector 26 likewise includes an insulating dielectric housing 27 that retains a plurality of electrical power receptacle contacts 55 that receive the complementary contacts 54 of the header connector 24 so as to connect the receptacle connector 26 to the cable connector assembly 21, and place the printed circuit board 31 and the external electrical device 36 in electrical communication. It should be appreciated that the configuration of FIG. 1 has been illustrated in accordance with one embodiment, and that alternative configurations are contemplated. For instance, the connector 26 can be configured as a header connector, and the connector 24 that receives the I/O cables 38 can be constructed as a receptacle connector whose contacts receive the contacts of the connector 26.

Figure 4:
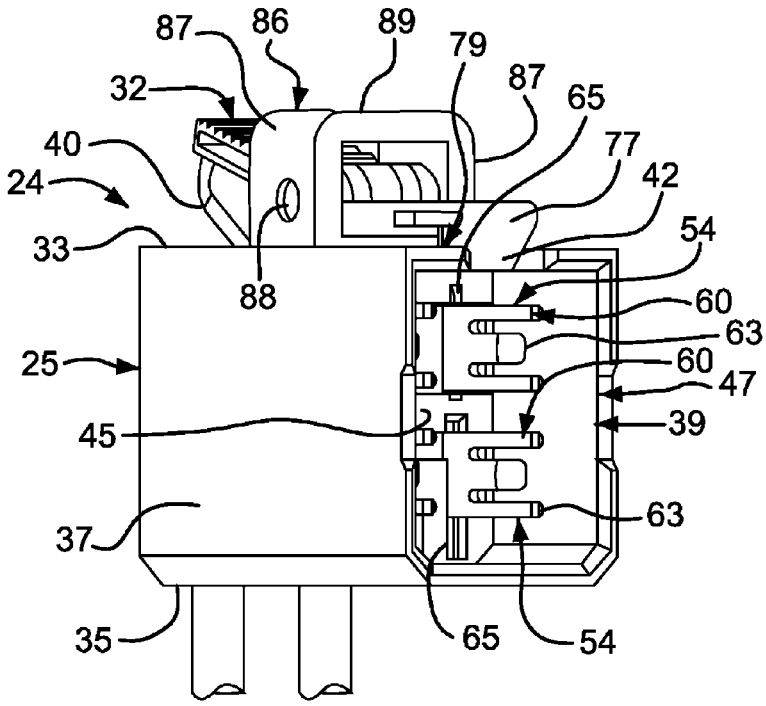
FIG. 4 is a perspective view of the mating end face of the header connector illustrated in FIG. 1.
Figure 5:
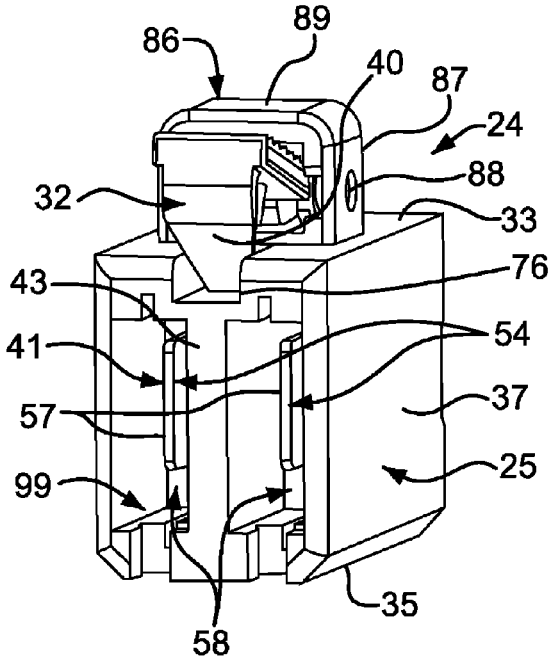
FIG. 5 is a perspective view of the mounting end of the header connector illustrated in FIG. 4 prior to installation of the cable assembly.

Referring now to FIGS. 4-5, the header connector housing 25 defines an upper wall 33, an opposing lower wall 35, and a pair of opposing laterally or horizontally spaced side walls 37 extending between the upper and lower walls 33 and 35. The walls 33, 35, and 37 define a mating end 39 configured to interface with the receptacle connector 26, and longitudinally opposing mounting end 41 configured to mate with the cable assembly 34. As illustrated, the mating end 39 is spaced forward from the mounting end 41, and the mounting end 41 is spaced rearward from the mating end 39.

It should be appreciated that the terms "vertical," "horizontal" or "lateral," "upper," "lower," "longitudinal," "forward," "rearward," and derivatives thereof are used to describe the communications system 20 and associated components in their illustrated orientations, and that the orientation of the system 20 and its components could be differ during use. Furthermore, the terms "outer," "inner," and derivatives thereof are used with respect to a device or component to refer to a direction toward and away from the geometric center of that device or component.

The header connector 24 is illustrated as a vertical connector, whereby the mating end 39 extends in a direction generally parallel to the mounting end 41, though the header connector 24 could alternatively be constructed as a right-angle connector in which the mating end 39 extends in a direction generally perpendicular to the mounting end 41, a mezzanine connector, or any alternative suitable connector configuration.

The housing 25 includes a vertical divider wall 43 that is connected between the upper and lower walls 33 and 35 at the mounting end 41 at a central location with respect to the side walls 37, and extends longitudinally toward the mating end 39 from the mounting end 41. The housing 25 thus defines a pair of spaced cable receiving chambers 58 at the mounting end 41. The forward end of the divider wall 43 terminates at a support wall 45 that extends laterally between the side walls 37. The support wall 45 is rearwardly spaced from the mating end 39, and defines a mating chamber 47 configured to receive the mating end of the receptacle connector 26.

Figure 6:
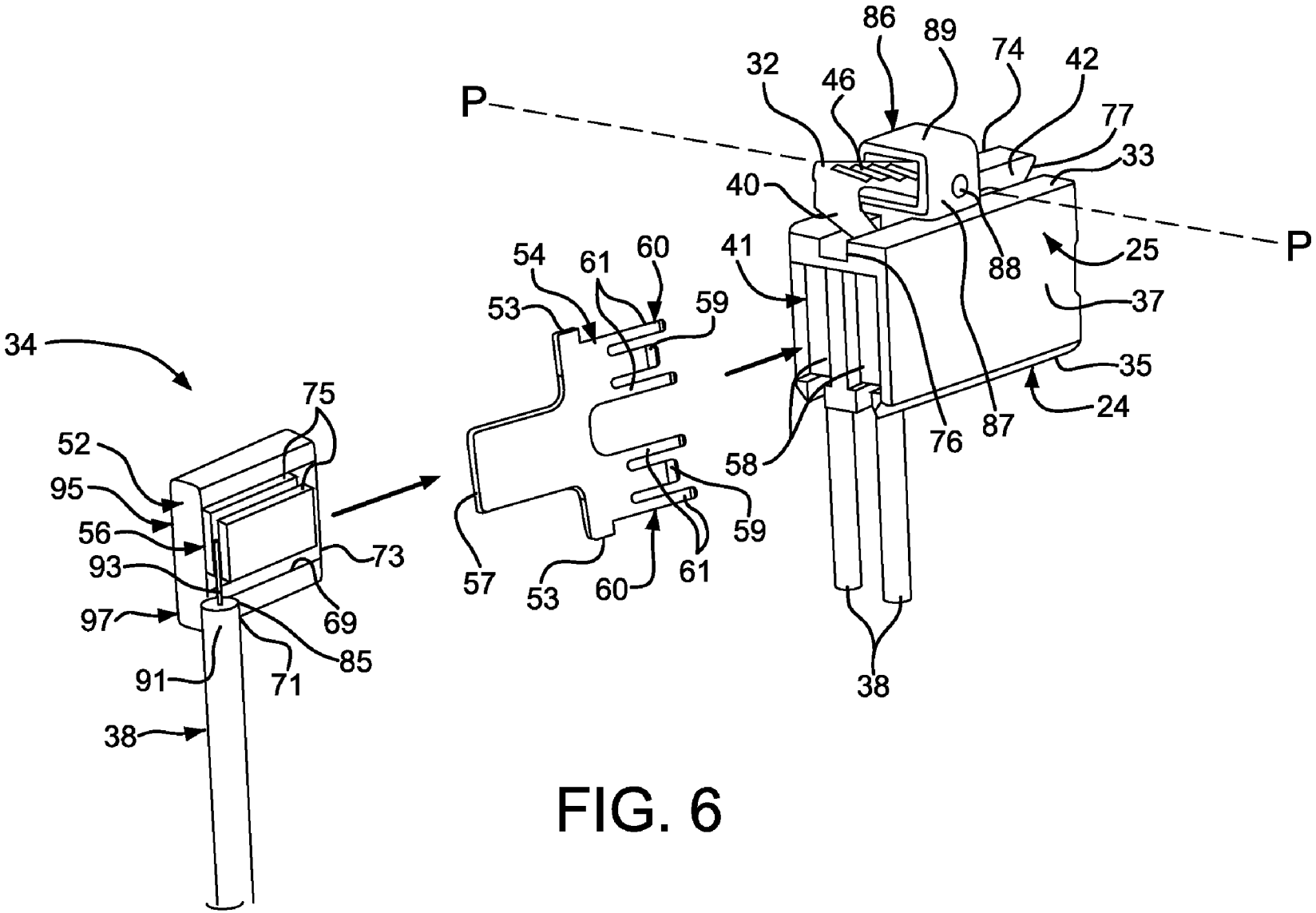
FIG. 6 is an assembly view illustrating the attachment of a cable assembly to the header connector illustrated in FIG. 1, the cable assembly including a faston that receives an electrical cable, wherein a portion of the faston is cut away to illustrate the connection of a cable to an electrical contact retained in the faston.

Referring now to FIGS. 4-6, the housing 25 retains a plurality (a pair as illustrated) of electrical power contacts 54. In particular, a power contact 54 is disposed in each cable receiving chamber 58, and separated from its adjacent power contact at the mounting end 41 by the divider wall 43. Each contact 54 includes a body 49, a blade 57 portion at the rear mounting end of the contact 54, and a pair of vertically spaced mating portions 60 extending forward from the front end of the body 49 at the mating end of the contact 54. The rear end of the blade 57 has a greater vertical dimension than the front end of the blade 57, and the upper and lower ends of the blade transition linearly between its rear and front ends. A pair of vertical tabs 53 project upward and downward, respectively, from the upper and lower ends of the body 49.

Each mating portion 60 includes a flexible middle finger 59 deflected laterally in one direction, and a pair of flexible flanking fingers 61 spaced vertically above and below, respectively, the middle finger 59. The flanking fingers 61 are deflected laterally in a direction opposite the middle finger 59. The forward ends 63 of the fingers 59 and 61 can be beveled laterally inwardly toward the vertical plane defined by the body 49. Of course, it should be appreciated that the contacts 54 have been described in accordance with the illustrated embodiment, and that numerous suitable alternative contact configurations are envisioned having a mounting end configured for connection to a cable assembly 34, and a mating end configured for connection to a mating connector.

The housing 25 includes a pair of vertically spaced slots 65 extending through the support wall 45 corresponding to the vertically spaced mating portions 60 of each contact 54. Each slot 65 is configured to receive one of the mating portions 60 of the corresponding contact 54, such that the corresponding tab 53 interferes with the support wall, thereby retaining the contact 54 in the housing 25. The contacts 54 are retained within the housing 25 such that the blade portions 57 are disposed in their corresponding cable receiving chambers 67, and the mating portions 60 are disposed in the mating chamber 47.

Figure 7:
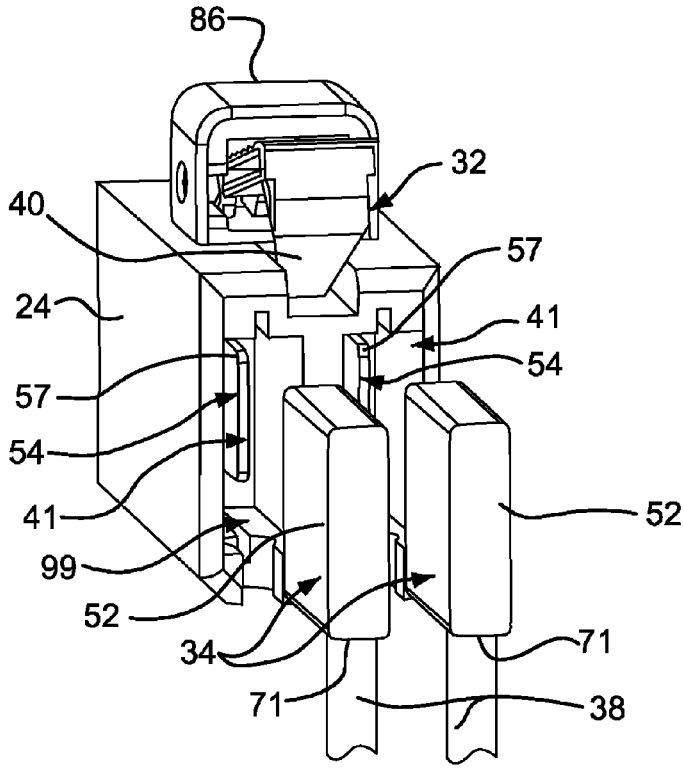
FIG. 7 is a perspective view of the header connector illustrated in FIG. 6 showing the cables being attached to the header connector.
Figure 8:
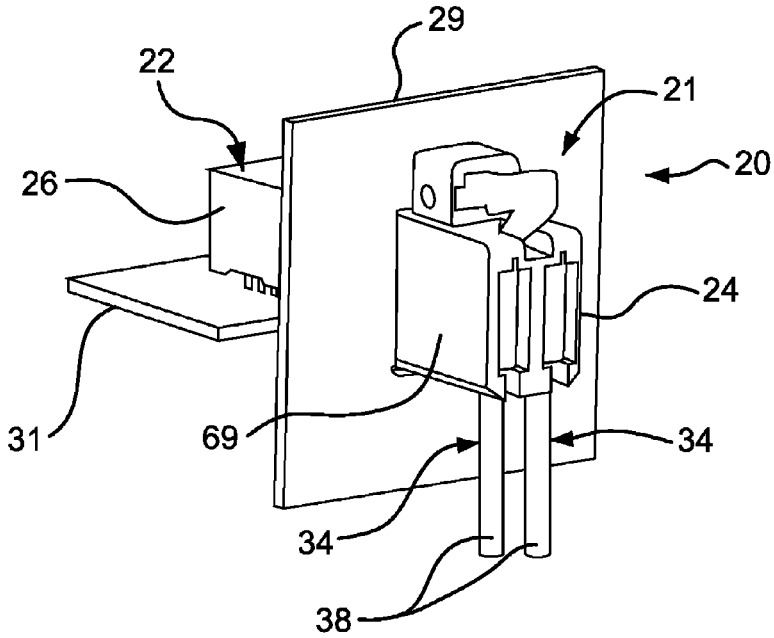
FIG. 8 is a perspective view showing the cables attached to the header connector illustrated in FIGS. 6-7, showing a faston with a portion removed to illustrate a receptacle contact retained in the faston.
Figure 11:
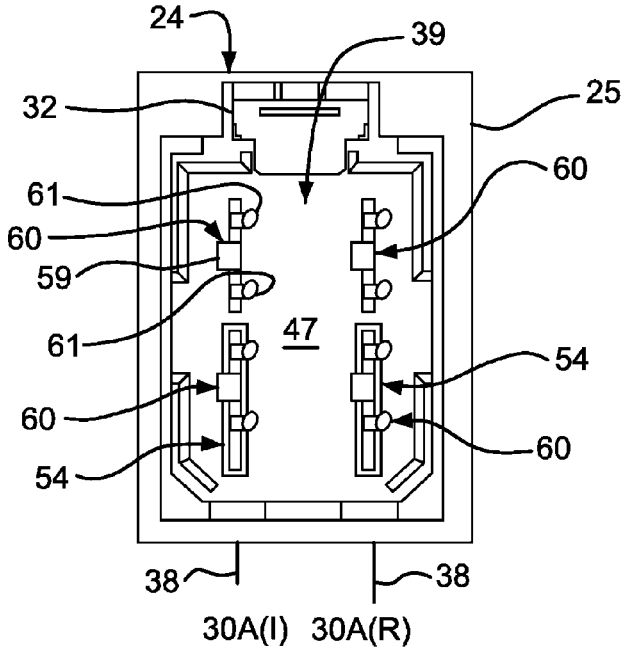
FIG. 11 s a side elevation view of a cable mating end face of the header connector illustrated in FIG. 1.

Referring now to FIGS. 6-8, a pair of cable assemblies 34 is provided for connection to the blade portions 57 of the electrical contacts 54 in the respective chambers 67 at the mounting end 41. Each cable assembly 34 includes an electrical power cable 38 that can be connected to the external electrical device 36, and a faston 52 that receives the power cable 38 and is configured to mate with the blade portion 57 of the corresponding electrical contact 54. One of the cables provides an input signal, while the other cable provides a return signal. In one embodiment, the cable assembly 34 provides an approximately 30 Amp input, and an approximately 30 Amp return, as shown in FIG. 11.

The faston 52 can include a dielectric housing 69 having a substantially cylindrical opening 85 in its bottom end that provides a mounting end 71 that receives the terminal end of the corresponding cable 38, which includes an insulation layer 91 that surrounds a cable wire 93. The housing further includes a receptacle mating end 73 that defines an opening configured to receive the blade portion 57 of the corresponding electrical contact 54. The opening 85 can be sized slightly greater than the outer diameter of cable insulation layer 91. The faston housing 59 further retains an electrical contact 56 having a pair of blades 75 that are joined at their proximal mounting end and laterally spaced apart from each other at their distal mating end. Thus, the mating end of the contact 56 provides a receptacle sized to snugly receive the blade portion 57 of the electrical contact 54. The electrical contact 56 may thus be referred to as a receptacle contact. The cable wire 93 extends out from the insulation layer 91 between the blades 75 at the proximal mating end of the contact 56.

The faston housing 69 presents a first crimp zone 95 and a second crimp zone 97 configured to secure the cable wire 93 to the contact 56, and thereby provide a strain relief mechanism for the associated cable 38. The housing 69 defines the first crimp zone 95 a location aligned with the proximal end of the contact 56. Once the cable 38 is inserted into the mounting end 71 such that the insulation layer 91 extends through the mounting end 71 and the cable wire 93 is disposed between the blades 75 at the proximal end of the contact 56, the housing 69 can be crimped at the first crimp zone 95, thereby squeezing the blades 75 against the cable wire 93 and securing the electrical connection between the cable wire 93 and the contact 56. The second crimp zone 97 is disposed at the lower portion of the rear end of the housing 69. Accordingly, the housing 69 can be crimped at the second crimp zone 97 around the insulation layer 91 to provide a friction fit between the housing 69 and the insulation layer 91.

Crimping the housing 69 at the first crimp zone 95 thus electrically connects the cable 38 to the faston connector 56, while crimping the housing 69 at the second crimp zone 97 provides strain relief to the cable 38. For instance, if a downward force is applied to the cable insulation layer 91 after the housing 69 has been crimped at the crimp zones 95 and 97, the frictional interference between the housing 69 and the insulation layer 91 at the second crimp zone 97 will prevent movement of the cable wire 93 at the first crimp zone, thereby protecting the electrical connection between the cable 38 and the contact 56.

It should thus be appreciated that the cable 38 extends vertically upward into the faston 52. The faston 52 includes a receptacle contact 56 retained within the housing 69 that is electrically connected to the cable 38 at its mounting end when the cable is installed in the faston 52, and receives the blade portion 57 of the electrical contact 54 at its mating end. Thus, the receptacle contact 56 is electrically connected between the associated cable 38 and electrical contact 54. The front end of the faston 52 can be sized to be press fit or otherwise inserted horizontally into the respective chamber 58 of the header housing 25, such that the blade portion 57 is received between the blades 75 of the receptacle contact 56, thereby electrically connecting the cable 38 to the header contact 54.

It should be appreciated that the faston 52 provides a right-angle contact that receives the cable 38 in a vertical orientation and connects to the header housing 25 in a horizontal orientation. Accordingly, once the faston 52 is installed in the header connector 24, the cable connector assembly 21 provides a right-angle connector whereby the mounting end 71 extends in a direction that is substantially perpendicular to the mating end 73, though it should be appreciated that the faston 52 can alternatively be constructed in any suitable connector configuration, such as a vertical connector, a mezzanine connector and the like. It should be further appreciated that the connector 24 is illustrated as including a pair of contacts 54 connected to a corresponding pair of cable assemblies 34 in accordance with the illustrated embodiment, however the connector 24 can include one or more contacts 54 that connect to a corresponding one or more cable assemblies 34 as desired.

Figure 9A:
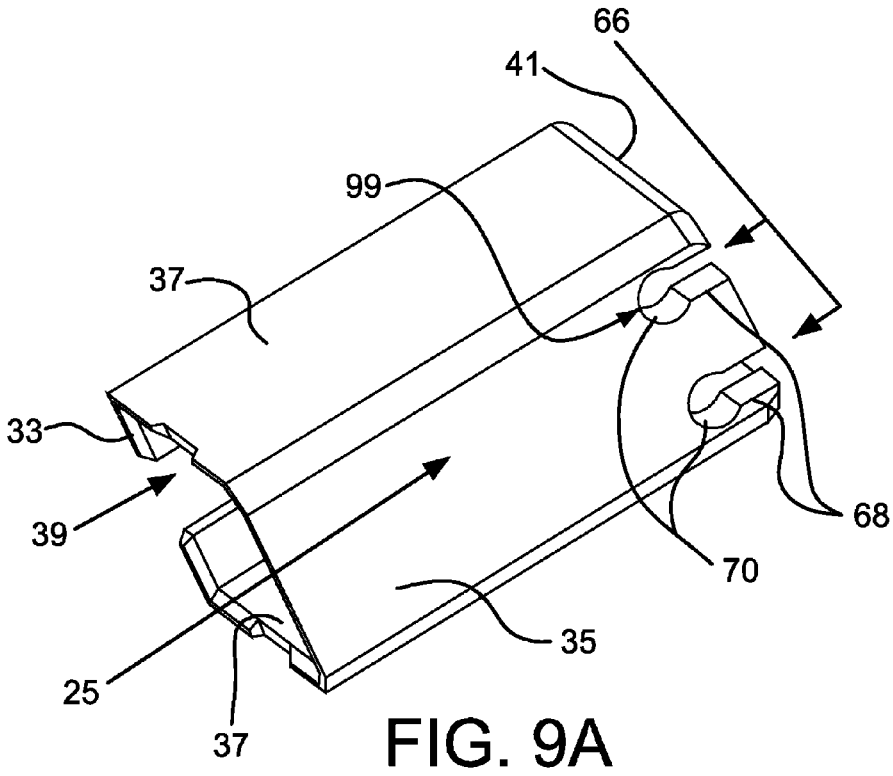
FIG. 9A is a bottom perspective view of the header connector housing illustrated in FIG. 6.
Figure 9B:
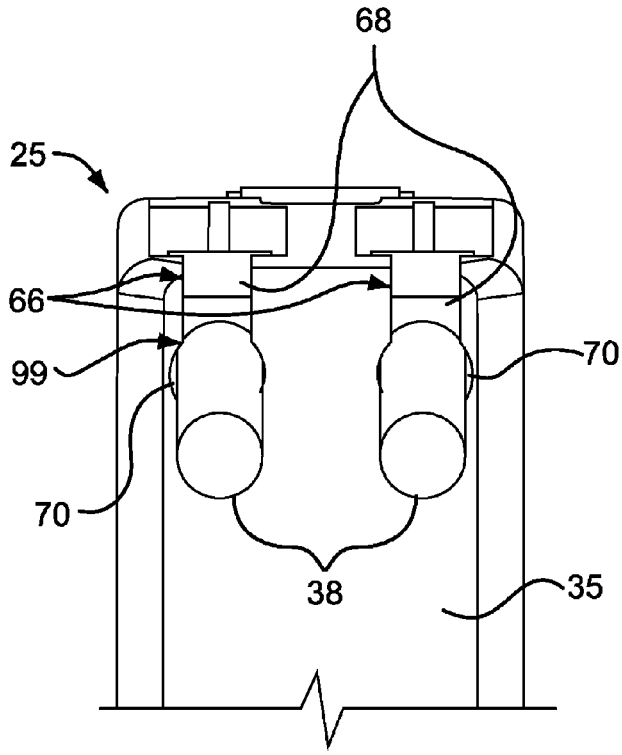
FIG. 9B is a bottom perspective view of the cables installed in the header connector housing illustrated in FIG. 9A.

Referring now to FIGS. 9A-B, the header connector housing 25 includes a pair of cable management systems or organizer 99 associated with each cable assembly 34 that maintains the associated cable 38 in a predetermined position separate from the other cable(s) 38. The cable management system includes at least one (and as illustrated a pair) cable position control slot 66 extending through the lower wall 35 of the header housing 25, and configured to receive the associated one of the cables 38. Accordingly, when the cable connector assembly 21 includes a pair of cable assemblies 34 connected to the header connector 24, the cable management system 99 includes a corresponding pair of slots 66 extending through the lower wall 35. Each slot 66 includes a neck 68 having an open first end 83 and a second end that is connected to an eyelet 70. The neck 68 has a thickness slightly less than that of the associated cable 38. The eyelet 70 can be round or can assume any suitable alternative geometric configuration having an inner diameter or other cross-sectional dimension that is substantially equal to, or slightly greater than, the diameter of the associated cable 38. Accordingly, as the cable assembly 34 is inserted into the header connector 24, the corresponding cable 38 is press-fit through the neck 68 and into the eyelet 70 to assist in retaining the cable at a location spaced apart from the cable 38 associated with the adjacent cable position control slot 66, thereby preventing the cables 38 from becoming tangled.

Thus, the strain relief mechanism is disposed in the faston 52 which is received by the housing, which provides the cable management system 99, which can also provide strain relief for the associated cable 38. It should be further appreciated that the cable management system 99 can additionally provide supplemental strain relief for the cable 38 if, for instance, the eyelet 70 defines an inner diameter or other cross-sectional dimension that is less than the outer diameter of the cable 38. In this embodiment, the eyelet lower wall 35 of the housing 25 would squeeze against the insulation layer 91, thereby providing relief for the connections between the faston housing 69 and the cable 38 at the crimp locations 95 and 97. For instance, when a force is applied to the cable 38 at a location downstream from the cable management system, the force would be absorbed at the eyelet 70, and would not be transferred to either crimp zone 95 or 97.

The cable assembly 34 can further include a supplemental cable management system if desired, which can be provided in the form of fiber optic boots, cable ties, sleeving, or the like that maintains the cables separate from the other cables.

Referring again to FIGS. 4-6, the electrical connector system 22 includes a single latch 32, and as illustrated only one latch 32, that facilitates removable attachment of the header and receptacle connectors 24 and 26. The latch 32 can be pivotally mounted to the upper surface of the upper wall 33 of the header connector housing 25, and includes a latch body 74 and a flexible lower spring flange 40 extending down (or inward) and forward from the rear end of the latch body 74. The lower flange 40 bears against the upper surface of the upper wall 33 of the header connector 24, and is curved so as to provide a spring force that biases the latch 32 toward a latched position that attaches the header connector 24 and the receptacle connector 26. The header connector 24 can include a longitudinally extending groove 76 formed in the upper wall 33 that is sized to receive the lower flange 40.

Figure 10:
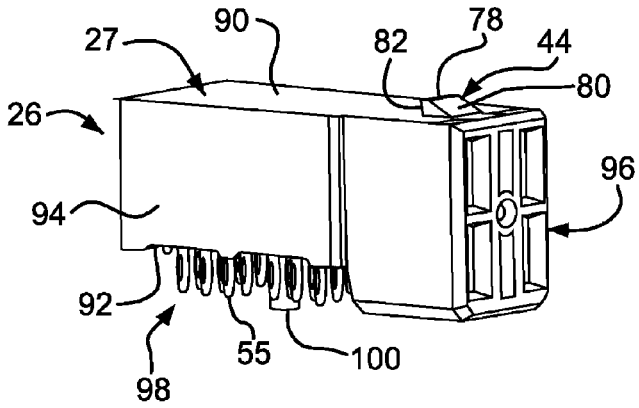
FIG. 10 is a perspective view of the receptacle connector including a latch retainer.

The latch 32 includes a barb 42 that projects inward (or down) from the front end of the latch body 74. The barb 42 defines a beveled leading edge 77 and a substantially vertical or rearwardly angled trailing edge 79. As shown in FIG. 10, the receptacle connector housing 27 carries a latch retainer 44 in the form of a projection 78 extending outward (or up) from the upper wall of the receptacle housing 26. The projection 78 defines a beveled forward edge 80 and a substantially vertical rear edge 82. It should be appreciated that the receptacle connector 26 defines a forward direction toward its mating end and a rearward direction away from its mating end.

Referring again to FIGS. 4-6, the latch 32 can further include an actuator 46 at the rear end of the latch body 74. Accordingly, the pivot axis is disposed between the actuator 46 and the barb 42 at a location vertically aligned with the header connector 24. The actuator 46 can be provided in the form of a textured upper surface 84 formed in the latch body. A generally inverted U-shaped bracket 86 can include vertical legs 87 that extend up from the upper wall 33 of the housing 25, and a lateral crossbar 89 that is connected to the upper ends of the legs 87. The bracket 86 can abut the back panel 29 when the header connector 24 is fully inserted into the back panel 29. The latch body 74 can be pivotally connected to the bracket 86, for instance via a pin 88 that extends through the latch body 74 and into the vertical legs 87, such that the pin 88 provides a pivot axis P-P about which the latch body 74 pivots between an engaged configuration and a disengaged configuration.

During operation, as the connectors 24 and 26 are mated as described in more detail below, the beveled leading edge 77 of the barb 42 cams over the beveled forward edge 80 of the projection 78 against the spring force provided by the abutment of the lower flange 40 against the upper wall 33. Thus, it should be appreciated that the latch body 74 extends through the opening 23 of the back panel 29. The leading edge 77 continues to cam over the beveled edge 80 of the projection until the barb 42 clears the projection 78, whereby the vertical trailing edge 79 slides past the vertical rear edge 82 of the projection 78. The spring force of the lower flange 40 biases the forward end of the latch body 74 downward to a position such that the barb 42 is aligned with the projection 78. Accordingly, the vertical trailing edge 79 of the barb 42 abuts and interferes with the rear edge 82 of the projection 78 so to prevent the connectors 24 and 26 from being inadvertently pulled apart. The latch 32 remains in this engaged configuration, whereby the connectors 24 and 26 are locked in their mated configuration, and are prevented from separating, until the latch 32 is actuated to a disengaged configuration.

When it is desired to separate the connectors 24 and 26, the actuator 46 is depressed against the spring force of the lower flange to a disengaged position, thereby causing the latch body 74 to pivot about the pivot axis defined by the pin 88 to a disengaged configuration whereby the barb 42 is lifted to a vertical position out of engagement with the projection 78. The connectors 24 and 26 can then be separated from each other. It should be appreciated that the latch 32 can be actuated to its disengaged configuration by manually depressing the actuator 46, thereby eliminating the need for specialized tools in order to remove the connectors 24 and 26 from the backplane. Furthermore, because the connector system 22 includes a single latch 32 that extends through the panel 29 on a horizontal surface, and the latch 32 is not laterally wider than the housings 25 and 27, the latch 32 does not limit the ability of the connector system 22 to be disposed immediately adjacent another connector system 22. Thus multiple electrical connector systems 22 can be mounted adjacent each other on a common backplane. Furthermore, a single latch limits the overall height of the connector system with respect to conventional connectors system that includes a pair of latches. In the illustrated embodiment, the latch 32 is disposed on one vertically spaced surface (vertically upper surface 33 as illustrated) which is opposite the vertically spaced surface that the cables 38 extends toward from the faston 52 (downward in the illustrated embodiment).

Referring now to FIG. 10, the receptacle connector 26 includes the receptacle connector housing 27 which defines an upper wall 90, an opposing lower wall 92, and a pair of opposing laterally or horizontally spaced side walls 94 extending between the upper and lower walls 90 and 92. The receptacle housing 27 has the same lateral and vertical dimensions as the header housing 25. The walls 90, 92, and 94 define a mating end 96 at the front end of the housing 27 that is configured to interface with the mating end 39 of the header connector 24, and a mounting end 98 defined by the lower wall 92. The receptacle contacts 55 project down from the lower wall 92 and connect to the printed circuit board 31 via any known connection mechanism, such as press-fit, solder, or the like (see FIG. 1). An alignment pin 100 also extends down from the lower wall 92 and is received in an alignment hole formed in the printed circuit board 31 for the purposes of accurately positioning the connector 26 on the printed circuit board.

Because the mounting end 98 extends in a direction that is generally perpendicular to the mating end 96, the receptacle connector 26 is constructed as a right-angle connector. It should be appreciated, however, that the receptacle connector 26 could alternatively be provided as a vertical connector, mezzanine connector, or any other suitable alternative connector configuration.

Figure 12:
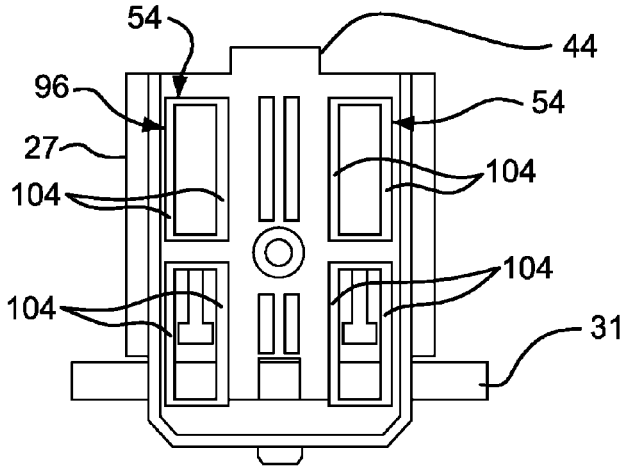
FIG. 12 is a side elevation view of a connector mating end face of the receptacle connector illustrated in FIG. 1.
Figure 13:
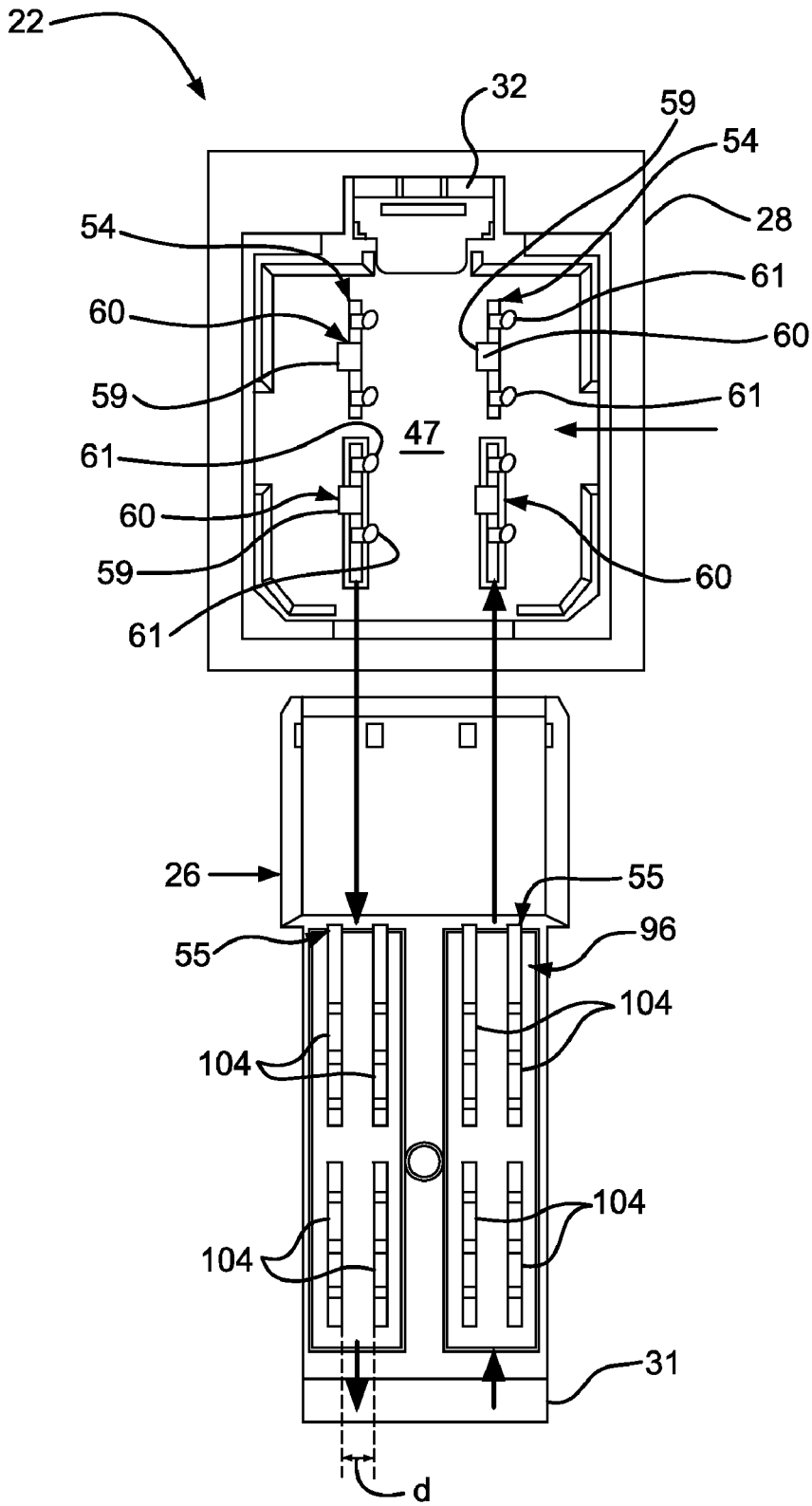
FIG. 13 is a side elevation view illustrating the header connector detached from the receptacle connector.

Referring now also to FIGS. 11-13, the mating end 96 of the receptacle housing 27 is sized to fit within the mating chamber 47 disposed at the mating end 39 of the header connector 24. Alternatively, the mating end 39 of the header connector 24 could fit inside the mating end 96 of the receptacle connector 26. Each receptacle contact 55 defines a pair of vertically spaced portions, each portion including a pair of blades 104 at the mating end 96 that are spaced apart laterally a distance "d" sufficient so as to receive a portion of the header contacts 54. In particular, each receptacle contact 55 defines a distance between its adjacent blades 104 that is substantially equal or slightly less than the lateral distance that separates the middle fingers 59 from the flanking fingers 61 of the header contact 54 that is received in the receptacle contact 55 when the header connector 24 and receptacle connector 26 are mated. As the connectors 24 and 26 are mated, the opposing inner lateral surfaces of the blades 104 can ride along the beveled forward ends of the fingers 59 and 61, thereby biasing the fingers to flex inwardly. The fingers 59 and 61 thus bear against the inner surface of the corresponding blades 104, thus ensuring contact between the header contacts 54 and the receptacle contacts 55.

Figure 14:
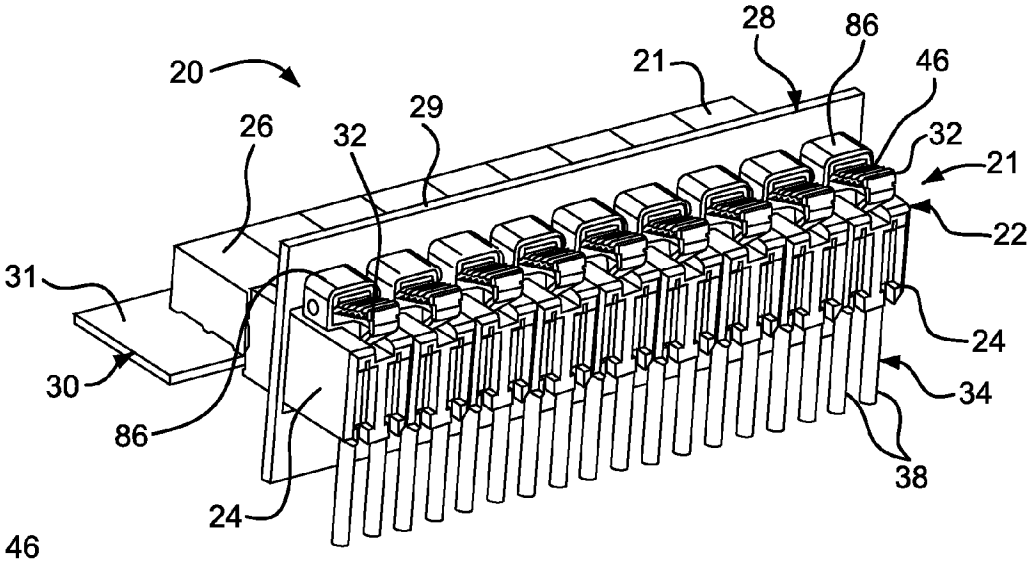
FIG. 14 is a front perspective view illustrating the communications system including a plurality of connector systems mounted onto a panel and connecting respective cables to a printed circuit board.
Figure 15:
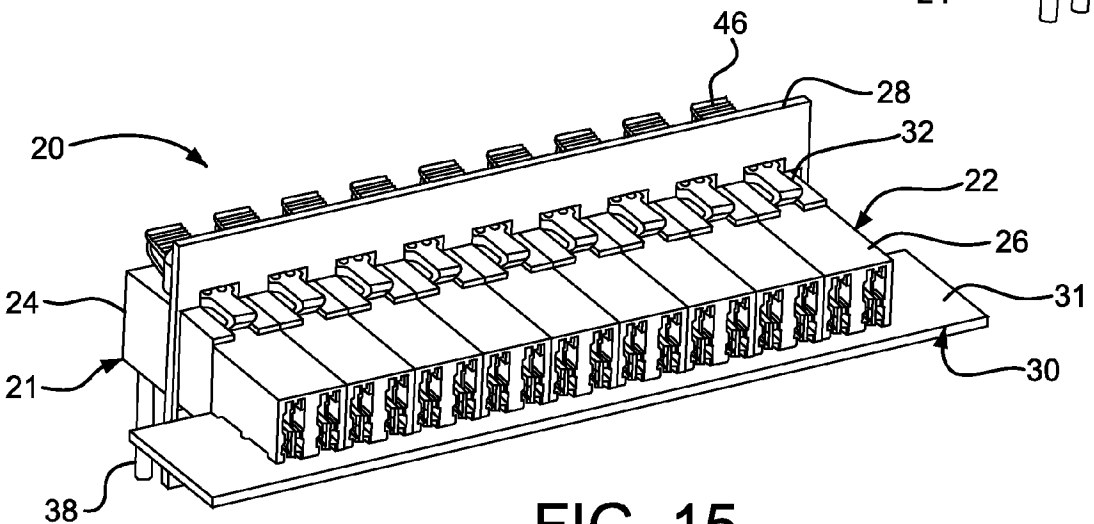
FIG. 15 is a rear perspective view illustrating the communications system illustrated in FIG. 14.

Referring to FIGS. 14-15, the communications system 20 can include a series of (for instance, nine) connector systems 22 that are mounted onto a common back panel 29, and electrically connect to a common printed circuit board 31. Thus, it should be appreciated that the communications system 20 as disclosed herein can include one or more connector systems 22 mounted onto a substrate 28 such as the back panel 29. As described above, the latch 32 can be actuated with a single finger. Because the latch 32 has a lateral distance greater than that of a human finger, multiple electrical connector systems 22 can be mounted immediately laterally adjacent each other on a common backplane such that little or no space exists laterally between adjacent header and receptacle connectors 24 and 26, thereby maximizing the utilization of space on the back panel 29. Accordingly, up to nine electrical connector systems 22 can be mounted along a lateral distance of 110 mm. or approximately 110 mm along the back panel 29. The multiple header connectors 24 mounted onto the common back panel 29 can be connected to the same or to different external electrical devices 36, and the multiple receptacle connectors 26 mounted onto the common back panel 29 can be mounted to the same or different printed circuit boards 31.

The embodiments described herein have been presented by way of illustration, and the present invention is therefore not intended to be limited to the disclosed embodiments. For instance, while certain components have been described as extending vertically or horizontally, these directional terms have been used for description purposes only, and it is appreciated that the components described herein can assume any desired orientation during use. Those skilled in the art will realize that the invention is intended to encompass all modifications and alternative arrangements included within the spirit and scope of the invention, as set forth by the appended claims.

What is claimed:

1. A electrical communication system configured to be mounted through an opening formed in a back panel, the communications system comprising:

a first electrical connector including a first housing that retains a first plurality of electrical power contacts, the first electrical connector defining a mating end and a mounting end, wherein the mounting end is configured to mate with a cable assembly;

a second electrical connector including a second housing that retains a second plurality of electrical power contacts, the second electrical connector defining a mating end configured to mate with the mating end of the first electrical connector, and a mounting end configured to mount onto a substrate, wherein the second electrical connector includes a latch retainer projecting out from the second housing; and no more than a single latch mounted to the first housing and extending through the opening formed in the back panel, the latch being configured for actuation between an engaged configuration, whereby the latch engages the latch retainer so as to prevent the first and second electrical connectors from separating, and a disengaged configuration, whereby the latch is out of engagement with the latch retainer so as to allow the first and second electrical connectors to separate from each other.

2. The electrical communication system as recited in claim 1, wherein the latch includes a latch body, a spring flange extending inward from the latch body and bearing against the first housing, and a barb projecting inward from the latch body, wherein the barb is configured to removably engage the latch retainer.

3. The electrical communication system as recited in claim 2, wherein the barb defines a beveled leading edge and the latch retainer defines a projection having a beveled edge, whereby the barb cams over the beveled edge of the projection when the first and second electrical connectors are mated.

4. The electrical communication system as recited in claim 1, wherein the spring flange biases the barb into interference with the latch retainer.

5. The electrical communication system as recited in claim 1, further comprising a bracket mounted onto the first housing, wherein the latch is pivotally mounted to the bracket, and pivots between the engaged configuration and the disengaged configuration.

6. The electrical communication system as recited in claim 1, wherein the first electrical connector is configured to mate with a pair of cable assemblies, each cable assembly including a faston that is connected to a cable, and the housing defines an organizer that receives one of the cables and maintains the received cable in a predetermined position separate from the other cable.

7. The electrical communication system as recited in claim 6, wherein the organizer further provides strain relief to the cable.

8. The electrical communication system as recited in claim 1, wherein the first electrical connector comprises a header connector, and the first plurality of electrical contacts comprise header contacts, and the second electrical connector comprises a receptacle connecter contacts that receive a portion of the header contacts when the header and receptacles connectors are mated.

9. The electrical communication system as recited in claim 1, further comprising a plurality of first and second electrical connectors connected on a common back panel, wherein the plurality of second electrical connectors is mounted onto a common substrate.

10. The electrical communication system as recited in claim 8, wherein each of the plurality of first electrical connectors is disposed immediately adjacent each other such that substantially no space is disposed between the adjacent first connectors.

11. The electrical communication system as recited in claim 10, wherein nine of the first electrical connectors fit along a length of 110 mm along the back panel.

12. A electrical communication system configured to be mounted onto a back panel, the communications system comprising:

a cable connector assembly including:

a first electrical connector including a first housing that retains a first plurality of electrical power contacts, the first electrical connector defining a first mating end and a first mounting end, a cable assembly configured to electrically connect the first electrical connector to an external electrical device, the cable assembly including a faston that defines a second mating end that is inserted inside the first mounting end, and a second mounting end that extends perpendicular to the mating end, the faston retaining a receptacle contact electrically connected between a cable and one of the first electrical power contacts;

wherein the faston provides strain relief to the cable, and the first housing provides a cable organizer that receives the cable and maintains the cable in a position spaced from an adjacent cable; and a second electrical connector including a second housing that retains a second plurality of electrical power contacts, the second electrical connector defining a third mating end configured to mate with the first mating end, and a third mounting end configured to mount onto a substrate.

13. The electrical communication system as recited in claim 12, wherein the faston is press-fit in the first mounting end.

14. The electrical communication system as recited in claim 10, wherein the cable organizer comprises a cable position control slot extending through the first housing.

15. The electrical communication system as recited in claim 14, wherein the cable position control slot includes a neck having first end that is open, and a second end that is connected to an eyelet, wherein the neck has a dimension less than that of the associated cable, and the cable is inserted through the neck into the eyelet.

* * * * *